US005088414A

United States Patent [19]

Vesa

[11] Patent Number: 5,088,414

[45] Date of Patent: Feb. 18, 1992

[54] SUBWARHEAD

[75] Inventor: Reijo Vesa, Karlskoga, Sweden

[73] Assignee: Aktiebolaget Bofors, Bofors, Sweden

[21] Appl. No.: 599,852

[22] Filed: Oct. 19, 1990

[30] Foreign Application Priority Data

Oct. 20, 1989 [SE] Sweden ..... 8903474

[51] Int. Cl.[5] ..... B64D 19/02; F42B 10/14; F42B 10/54; F42B 12/58

[52] U.S. Cl. ..... 102/388; 102/393; 102/476; 244/3.27

[58] Field of Search ..... 112/386, 388, 393, 476, 112/489, 306; 244/3.27, 3.28, 3.29

[56] References Cited

U.S. PATENT DOCUMENTS

| | | | |
|---|---|---|---|
| 1,318,926 | 10/1919 | Settle | 102/386 |
| 2,044,819 | 6/1936 | Taylor | 102/386 |
| 3,098,445 | 7/1963 | Jackson | 244/3.28 |
| 3,273,834 | 9/1966 | Bower | 102/388 |
| 3,964,391 | 6/1976 | Zacharin | 244/3.27 |
| 3,978,790 | 9/1976 | Sandelius | 244/3.27 |
| 4,162,053 | 7/1979 | Björnson | 244/3.27 |
| 4,492,166 | 1/1985 | Purcell | 102/384 |
| 4,829,903 | 5/1989 | Axinger et al. | 102/384 |
| 4,858,532 | 8/1989 | Persson et al. | 102/387 |

FOREIGN PATENT DOCUMENTS

| | | | |
|---|---|---|---|
| 713285 | 11/1941 | Fed. Rep. of Germany | 102/386 |

*Primary Examiner*—David H. Brown
*Attorney, Agent, or Firm*—Pollock, Vande Sande & Priddy

[57] ABSTRACT

A subwarhead adapted for separation from a missile, for example a carrier shell or the like, over a target area comprises an active part, a target detector and an arrangement which imparts a rotation to the subwarhead for scanning of the target area in a helical pattern during the descent of the subwarhead towards the target area, the target detector being arranged displaceably in order to allow a free view at the side of the active part. Two diametrically situated aerofoils are pivotable, each on its own shaft situated in a plane which is at right angles to the axis of symmetry of the active part, from a folded position, in which the aerofoils connect with the outer surface of the subwarhead, to a position folded out by 90°, in which the two aerofoils form a braking area for controlling the rate of descent of the subwarhead.

5 Claims, 1 Drawing Sheet

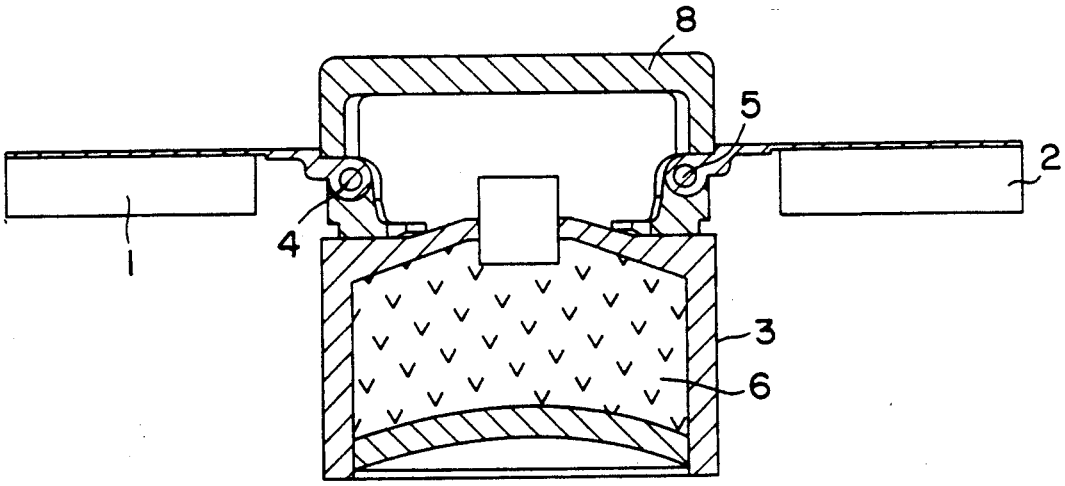
FIG. 1
FIG. 2
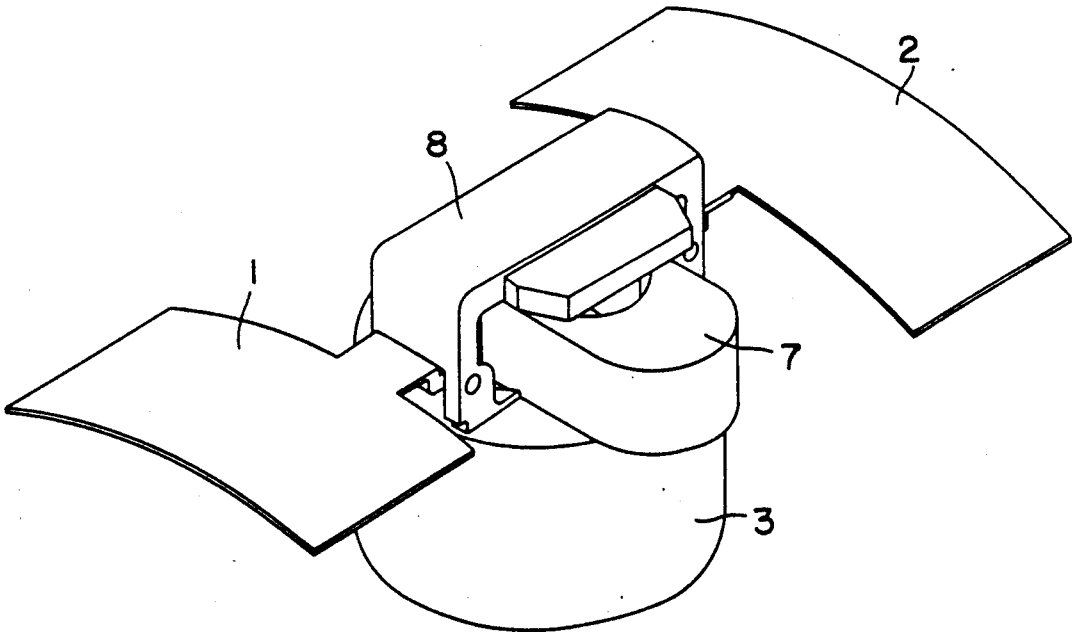

SUBWARHEAD

FIELD OF THE INVENTION

The present invention relates to a subwarhead arranged to be separated from a missile, for example a carrier shell or the like, over a target area, the subwarhead comprising an active part, a target detector and means which imparts a rotation to the subwarhead for scanning of the target area in a helical pattern during the descent of the subwarhead towards the target area. Such a subwarhead is previously described in the U.S. Pat. No. 4,858,532.

SUMMARY OF THE INVENTION

Characteristic of the subwarhead described in this patent is the fact that the target detector is arranged pivotably on a bearing shaft which is parallel with the line of symmetry of the active part in order to allow pivoting out of the target detector from a folded position, in which the optical axis of the target detector coincides with the line of symmetry of the active part, to an unfoleded position, in which the optical axis of the target detector is parallel with the line of symmetry of the active part, in order to allow a free view by the target detector at the side of the active part. Furthermore, an aerofoil is pivotably arranged on a bearing shaft which is also parallel with the line of symmetry of the active part in order to allow pivoting out of the aerofoil from a folded position to an unfolded position at the side of the active part.

By means of an expedient aerodynamic design of the subwarhead and the braking area of the detector and the aerofoil, a suitable rate of descent of the subwarhead and furthermore a driving moment, which imparts to the subwarhead its rotation around the axis of spin are obtained. This is brought about without assistance from a parachute, which is an advantage since the parachute takes up space. Within thus available space in a carrier shell, an increased space can instead be made available for the active part itself.

Although the subwarhead described above has proved to have good characteristics as far as rate of descent and scanning rotation are concerned, it has become desirable to be able to further increase the braking area. This can be the case, for example, when it is desired to use heavier active parts. The braking area of the target detector and aerofoil is limited to the cross-sectional area of the cylindrical subwarhead, which can result in the rate of descent becoming too high, with the existing size of the braking area, if the weight of the active part is increased at the same time.

The main purpose of this invention is to produce a subwarhead of the abovementioned type but with a substantially greater braking area. According to the invention, this is achieved in a simple manner and without the use of extra space.

The present invention is described below in greater detail with reference to the attached drawing which shows an example of how a subwarhead according to the invention can be designed.

BRIEF DESCRIPTION OF THE DRAWINGS

FIG. 1 shows a side view, partly in cross-section, of the present invention subwarhead in its unfolded position; and FIG. 2 shows a perspective view of the subwarhead in its unfolded position.

DETAILED DESCRIPTION OF THE PREFERRED EMBODIMENT(S)

The subwarhead is assumed to have been separated from a carrier shell. The carrier shell can be one of 15.5 cm caliber, for example, which has been fired from a field artillery piece in conventional manner in a ballistic trajectory towards a target area. In order to give the subwarhead a controlled movement of scanning of the target area, that is a controlled rotation and rate of descent, two diametrical aerofoils (1, 2) are arranged to be pivotable from a folded in position, in which the aerofoils connect with the outer surface 3 of the subwarhead, into an unfolded position, in which the two aerofoils form a braking area. The two aerofoils 1, 2 are pivotably arranged on folding-out shafts 4, 5 which are at right angles to the line of symmetry of the active part. The active part 6 can be of a type known and is thus not described further here.

In contrast to the subwarhead which is described in the U.S. Pat. No. 4,858,532 mentioned in the introduction, the target detector in this case constitutes a part 7 separate from the two diametrically suspended aerofoils 1, 2. In order to allow a free view at the side of the active part, the target detector 7 is arranged to be displaceable or pivotable from a folded in position in the stirrup-like superstructure 8, in which the two folding-out shafts 4, 5 are also arranged, on the active part.

By virtue of this construction, the two aerofoils can be given a greater braking area. They can furthermore be made comparatively thin, which is favorable as far as weight is concerned. The aerofoils can be made of titanium, for example, and are curved so that they have a given radius in their unfolded position. The material is elastically flexible so that the aerofoils, in the folded in position, connect with the outer surface of the subwarhead but, in the unfolded position, are bowed out into their curved position. By varying the curvature of the aerofoils, a further parameter is obtained for varying the flight characteristics. The aerofoils can furthermore be of different length, which influences the rate of rotation of the subwarhead.

In their folded in position, the aerofoils are locked to the outer surface of the subwarhead in a suitable manner, for example the thin aerofoil profile can engage in a groove or slot in the outer surface. The aerofoils are rotated from their folded position with the aid of their internal energy, rotational and air forces by approximately 90° into their folded position The two aerofoils can be combined with an aerodynamic rotational brake of a known type, which is described in U.S. Pat. No. 4,829,903.

I claim:

1. A subwarhead which is separable from a missile over a target area, comprising:

an active part;

a target detector, said target detector being displaceably mounted on the warhead in order to allow a free view at the side of the active part; and means for imparting a rotation to the subwarhead for scanning of the target area in a helical pattern during the descent of the subwarhead towards the target area, said means including two diametrically situated aerofoils which are pivotably mounted on said warhead each about its own shaft, said shafts being positioned in a plane which is substantially at right angles to the axis of symmetry of said active part, said aerofoils being pivotable from a folded position, in which said aerofoils are in contact with the outer surface of the subwarhead, outwardly by 90° to an unfolded position, in which said aerofoils form a braking area for controlling the rate of descent of the subwarhead and wherein said aerofoils are of different length.

2. A subwarhead according to claim 1, wherein said aerofoils are made from an elastically flexible material so that when the aerofoils pivot out from their folded position they at the same time are bowed out into a substantially straight or slightly curved surface.

3. A subwarhead according to claim 1, wherein said target detector is pivotably mounted on said warhead and separate from said aerofoils.

4. A subwarhead which is separable from a missile over a target area, comprising:

an active part;

a target detector, said target detector being displaceably mounted on the warhead in order to allow a free view at the side of the active part; and means for imparting a rotation to the subwarhead for scanning of the target area in a helical pattern during the descent of the subwarhead towards the target area, said means including two diametrically situated aerofoils which are pivotably mounted each on its own shaft, said shafts being situated in a plane which is substantially at right angles to the axis of symmetry of the active part, said aerofoils being made from an elastically flexible material and pivotable from a folded position outwardly by 90° to an unfolded position, said flexible aerofoils being precurved to a predetermined curvature selected for desired flight characteristics and in said folded position are in contact with the outer surface of the subwarhead, and in said unfolded position form a braking area for controlling the rat of descent of the subwarhead, said predetermined curvature being maintained in said unfolded position.

5. A subwarhead according to claim 4, wherein said aerofoils are of different length.

* * * * *